United States Patent [19]

Meinkowsky

[11] Patent Number: 4,612,943

[45] Date of Patent: Sep. 23, 1986

[54] DISPENSER FOR SNUFF AND THE LIKE

[76] Inventor: Larry J. Meinkowsky, Rte. 5, Box 582, Hallettsville, Tex. 77964

[21] Appl. No.: 520,835

[22] Filed: Aug. 5, 1983

[51] Int. Cl.[4] ..... A24F 47/00

[52] U.S. Cl. ..... 131/329

[58] Field of Search ..... 131/329; 222/336, 409, 222/228, 192, 191, 137, 344, 328; 206/236; 270/306; 215/327, 380

[56] References Cited

U.S. PATENT DOCUMENTS

| | | | |
|---|---|---|---|
| 130,757 | 8/1872 | Snyder | 222/191 |
| 1,515,000 | 11/1924 | Thompson | 222/344 |
| 1,827,564 | 10/1931 | Comrie | 222/137 |
| 2,072,506 | 3/1937 | Leustig | 222/328 |
| 2,092,219 | 9/1937 | Knox | 206/236 |
| 2,130,466 | 9/1938 | Lapierre | 222/336 |
| 2,210,776 | 8/1940 | Polkingharn | 222/409 |
| 3,201,004 | 8/1965 | Plonski | 222/228 |
| 4,098,421 | 7/1978 | Foster | 220/306 |
| 4,190,170 | 2/1980 | Boyd | 215/307 |
| 4,307,734 | 12/1981 | Blankenship | 131/329 |

*Primary Examiner*—V. Millin

*Attorney, Agent, or Firm*—Vaden, Eickenroht, Thompson, & Boulware

[57] ABSTRACT

A dispenser for metering doses of pulverulent material (e.g., snuff) from an open end of a container directly to the user. A cap is press-fitted upon the open end by an upstanding rim carried on a flat base. The case has parallel guides and a passage therethrough to the open end. An elongated spoon slide reciprocates by one-handed operation within the guides between closed and delivery positions. The spoon slide is biased by a spring into the closed position for safe carrying of the container. A valve tongue in the spoon slide defines an adjustable volume chamber to be filled with material from the container in the closed position, and closes tightly the passage in the delivery position where a dose of material is dispensed to the user.

10 Claims, 14 Drawing Figures

FIG. 5
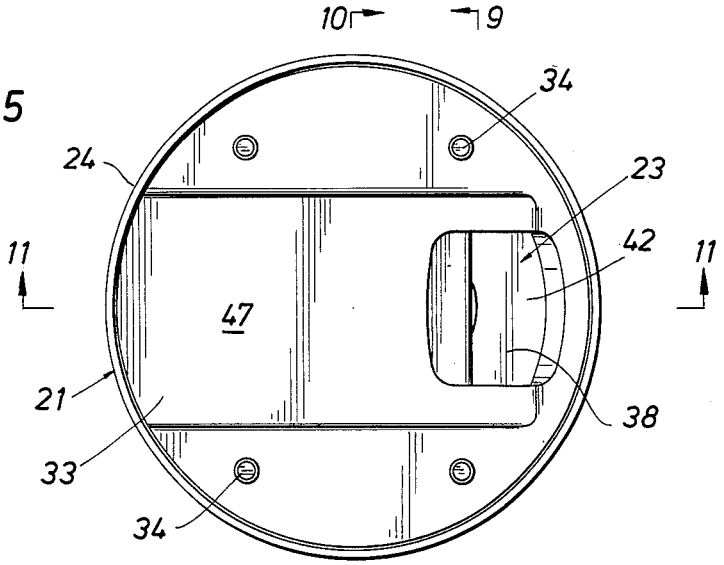
FIG. 6
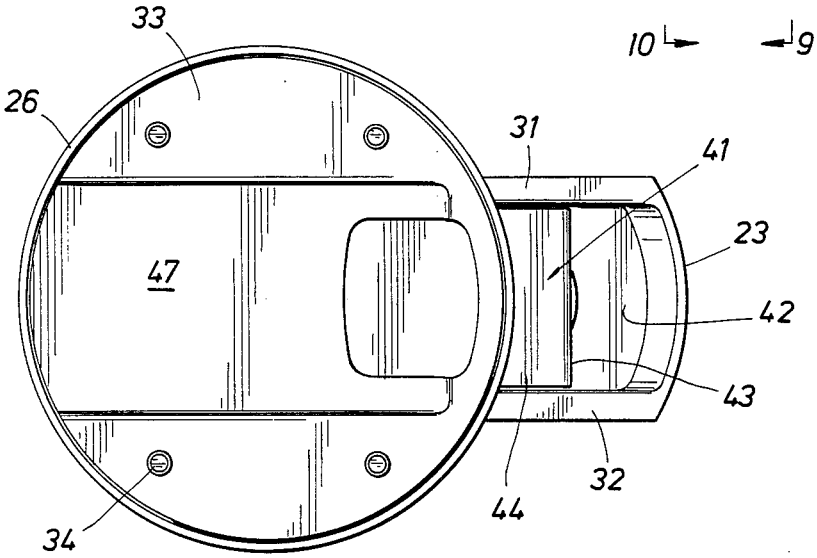
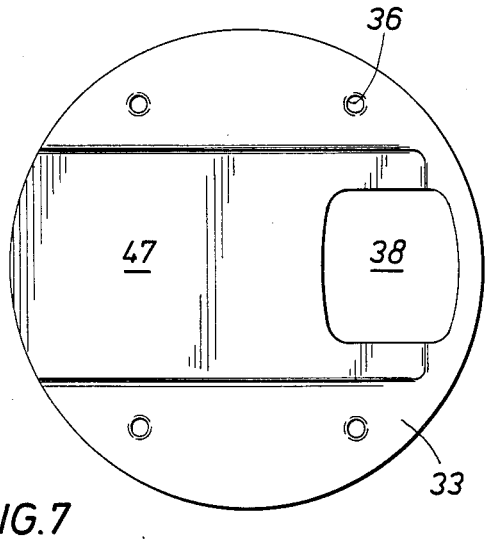
FIG. 7
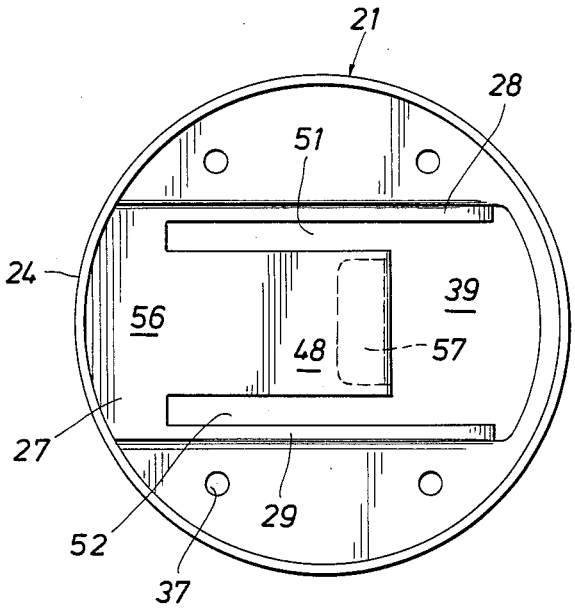
FIG. 8

FIG. 9
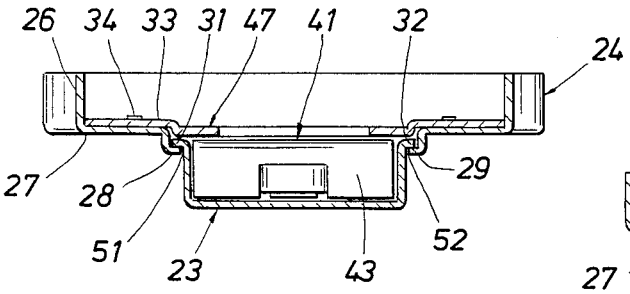
FIG. 10
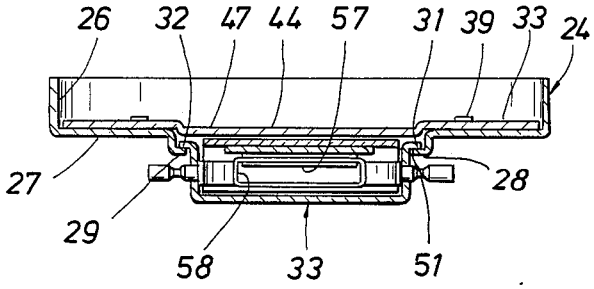
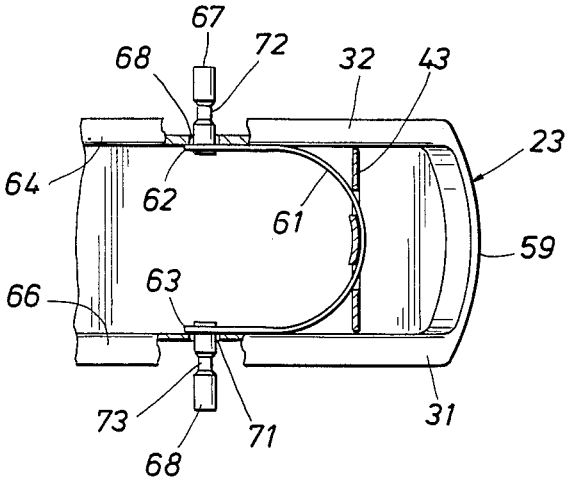
FIG. 12
FIG. 13
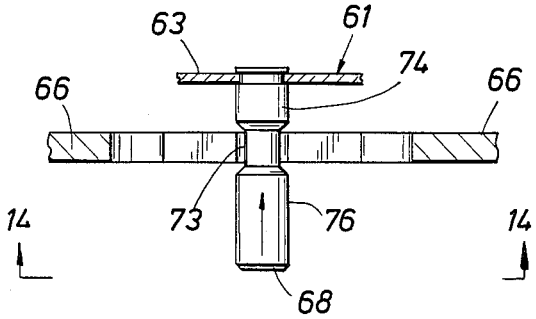
FIG. 14
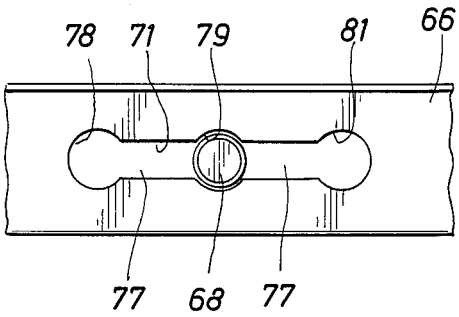
FIG. 11
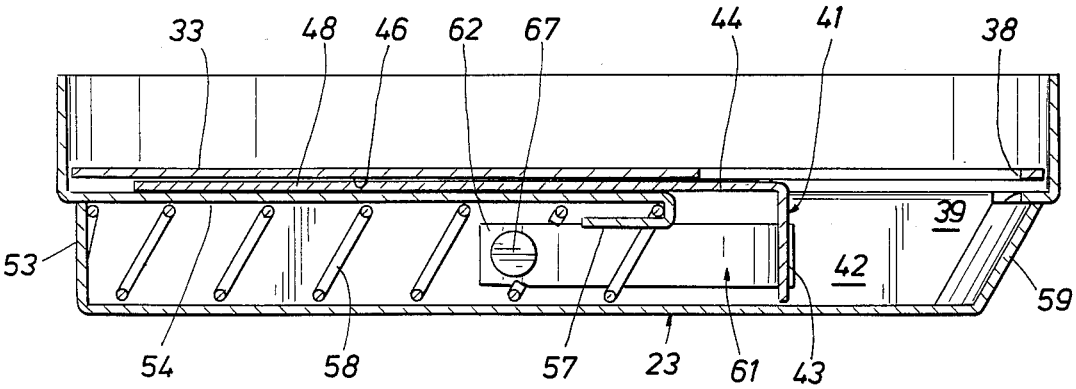

DISPENSER FOR SNUFF AND THE LIKE

BACKGROUND OF THE INVENTION

1. Field of the Invention

This invention relates to the dispersing of pulverulent material, and it relates more particularly to a press-on dispenser mounted upon a container for delivery of a selected precise amount of snuff without leakage or loss.

2. Description of Prior Art

Various devices have been proposed for the delivery of certain amounts or doses of powdery or pulverulent materials such as sugar, coffee, baking powder and snuff. Many of these devices are adequate for handling the course granular materials such sugar and coffee. However, the usual devices may deliver doses of finely divided powders, but these devices are either complex and expensive, or they suffer from problems of powder leakage in their closed positions or they have complex constructions that can be expensive, unreliable and bulky in mass.

For example, there are many people who use tobacco in the powdered or pulverulent form commonly known as snuff. Snuff is formed of very fine particles (e.g., 1000 micrometers in diameter). Naturally, the user will try to select a certain volume pinch or dose of the snuff which gives to him the greatest and longest pleasurable sensation. Unfortunately, snuff is available in containers, usually formed in a cylinder, having a removeable top end. Once the top end is removed, the container has an open end. This open end can be sealed by a cap that press-fits the end of the container. When the user desires a dose of snuff, the cap is removed and the snuff amount removed by pinching some between the fingers or by use of a small spoon or knife blade etc., as a measuring device. Naturally, this mode of getting a dose of snuff is easily accomplished when the user is seated or otherwise stationary. However, the securing and measuring of a certain dose of snuff from the container, without unintentional spillage thereof, is a monumental challenge while driving a truck, riding a horse or operating mechanized machinery. In addition, the container must be tightly sealed when carried in the users pocket etc. until the desire for another dose of snuff is desired.

The present invention is a dispenser of a dose of snuff or like pulverulent material whose volume is readily adjusted by the user. The dispenser provides a pushon cap for tightly sealing a container of the material, but capable of ready delivery of the precise dose when desired using only one hand for this purpose. Adjustment of the volume of the dose is by a simple, easy to use, trouble free mechanism. The dispenser is compact and smooth surfaced without projections for non-snagging coverage in the pockets of the user.

SUMMARY OF THE INVENTION

In accordance with this invention, there is provided a dispenser for metering doses of a pulverulent material from the open end of a container to the user. A cap mounts upon the open end of the container by an upstanding rim. The cap has a flat base with parallel guides and a passage exposed to the open end. An elongated spoon slide reciprocates in the guides across the flat bottom between closed and delivery positions. A chamber for measuring the dose is defined at one end of the slide by a valve tongue that also closes by a gate the passage. In the closed position, material fills the chamber through the passage. In the delivery position, the slide places the gate across the passage and delivers the dose to the user.

DESCRIPTION OF THE DRAWINGS

FIG. 5 is an interior plan view of the present dispenser (in closed condition) demounted from the container of snuff;

FIG. 6 is a view of the dispenser like FIG. 5 but in its delivery condition;

FIG. 7 is a plan view of an inside cover used in the present dispenser;

FIG. 8 is a bottom view of the dispenser but with the spoon slide and biasing spring removed from it;

FIG. 9 is a cross section taken along line 9—9 of the dispenser shown in FIG. 5;

FIG. 10 is a cross section taken along line 10—10 of the dispenser shown in FIG. 5;

FIG. 11 is a cross section taken along lines 11—11 of the dispenser shown in FIG. 5;

FIG. 12 is a partial interior view of the spoon slide used in the present dispenser;

FIG. 13 is an enlarged partial view of the volume adjustment detent mechanism used in the spoon slide; and FIG. 14 is an enlarged partial section along line 14—14 of the mechanism in FIG. 13, which provides by the detent mechanism for volume adjustment of the dose measurement chamber in the present dispenser.

DESCRIPTION OF PREFERRED EMBODIMENT

Figure 1:
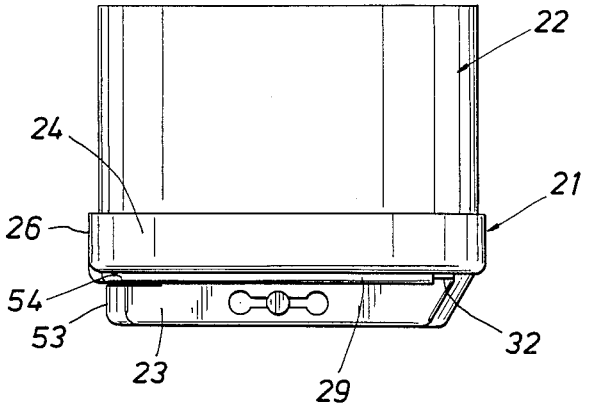
FIG. 1 is an elevation of the present dispenser in its closed condition mounted upon a container of snuff.
Figure 2:
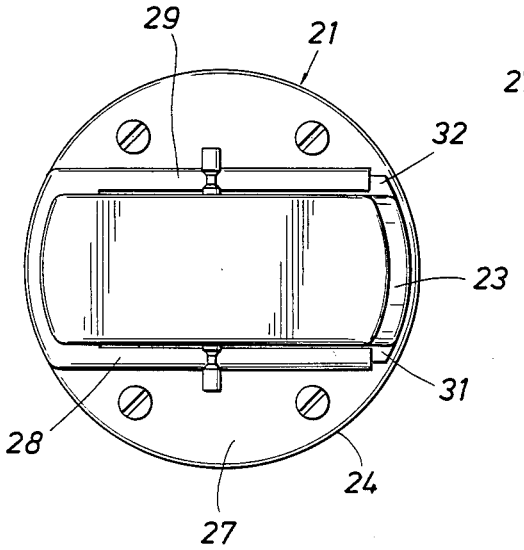
FIG. 2 is a bottom view of the dispenser of FIG. 1.

Referring now to FIGS. 1 and 2, there is shown the present dispenser 21 mounted over the open end of a container 22 of pulverulent material (e.g., a can of snuff). The dispenser 21 is shown in the closed condition wherein no material can escape and be lost to the user. No sharp or hook-like projections extend from the dispenser to snag on the users clothing, especially pockets in which the dispenser is carried. The dispenser 21 carries a spoon slide 23 which receives a preset volume of the material in the closed position but seals tightly the open end of the container 22. None of the material can escape from the dispenser 21. The dispenser 21 can be constructed of metal or plastic, either by stamping or molding, or by other constructions.

Figure 3:
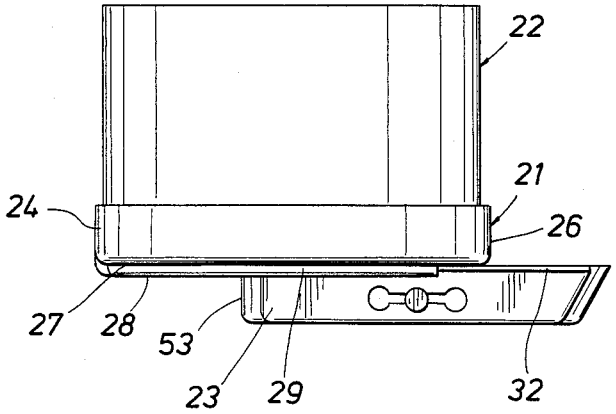
FIG. 3 is an elevation of the present dispenser in its delivery condition.
Figure 4:
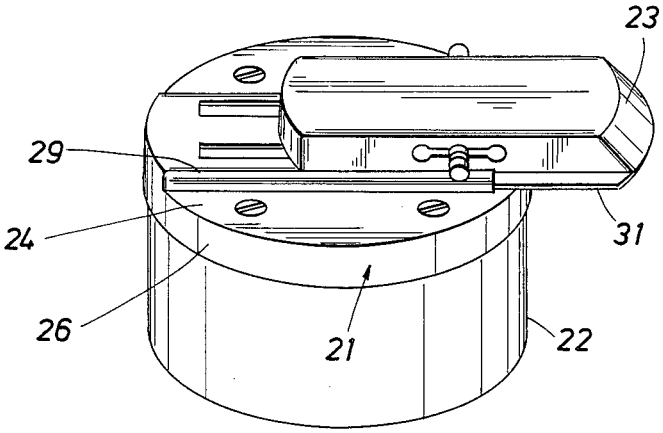
FIG. 4 is an elevation of the dispenser of FIG. 3 inverted to deposit the dose of material into the users mouth or hand.

The user will place the dispenser 21 into the upright position shown in FIG. 1. Then, the spoon slide 23 will be moved from the closed position to the delivery position shown in FIGS. 3 and 4. This operation can easily be done one-handed by the user, usually using the 3rd finger or middle finger to move the spoon slide 23 with the adjoining fingers holding the dispenser and container. The material can be delivered, as shown in FIG. 3, if the user wishes to pinch it into his nose, or for other reasons. Alternatively, the dispenser can be inverted, as seen in FIG. 4 for depositing the material by dropping into the users hand, or if snuff, directly behind the user's lower lip.

The dispenser 21 can be formed of a lid or cap 24 carrying an upstanding rim 26 which press-on fits about the open end of the container 22. A flat base 27 extends across the cap 24 and can merge by smooth curves into the rim 26. The base 27 carries parallel guides 28 and 29, which guides extend substantially diametrically across the cap 24. The spoon slide 23 reciprocates on bent edged flanges 31 and 32 within these guides 28 and 29 between its closed and delivery positions. Preferably, the spoon slide has an open top, parallel sides, a flat bottom and sloping ends to give it an elongated boat-like configuration.

Referring now to FIGS. 5 and 6, an inside cover 33 is secured, as by fasteners or spot welds 34, within the cap 24. The fasteners pass through a plurality of holes 36 aligned with indexed holes 37 in the cap 24, as seen in FIGS. 7 and 8.

The cover 33 and cap 24 have aligned openings 38 and 39 between the guides 28 and 29 to provide a passage for the material from the open end of the container 22. It is through this passage that the material fills a chamber formed in the slide spoon 23. More particularly, the slide spoon 23 carries a valve tongue 41 that defines a chamber 42 in which is measured a selected volume of the material which fills same via the passage provided by openings 38 and 39 from the container 22. In addition, the tongue 41 provides a gate to seal the openings 38 and 39 against flow of the material when the spoon slide is in closed position (as shown in FIGS. 1, 2 and 5).

The tongue 41 can be a sheet metal strip bent into right angles with a first end 43 conforming to the interior of the spoon slide for forming a divider defining the chamber 41 and a flat second end 44 forming the gate sealing the openings 38 and 39. The second end 44 of the tongue presses firmly against the lower surface 46 (see FIG. 11) of the cover 33. For this purpose, the cover 33 can be provided with a depressed flat surface 47 to cooperate with the second end 44 in providing the material proof seal. In addition, the second end 44 can be supported (as seen in FIGS. 8 and 11) in operative sliding condition by a guide strip 48 formed within the base 27. The reciprocation of the second end 44 between the surface 46 and guide strip 48 forms a material tight but self cleaning gate valve function. The strip 48 is defined by parallel slots 51 and 52 also formed in the base 27. The slots merge into the opening 39. The flanges 31 and 32 travel within these slots while underengaging the guides 28 and 29, respectively. For clearance purposes, the end 53 of the spoon slide 23 is reduced by a stepped surface 54 which in the closed position overlays the tee portion 56 on the base 27.

The free end of the strip 48, as best seen in FIGS. 8, 10 and 11 is formed into a hook 57 which resides beneath the gate or end 44 of the tongue 41. A helical or rectangular configured coiled spring 58 is received at one end behind the hook 57 and its other end rests against the sloping end 53 of the spoon slide 23. As a result, the spoon slide 23 is firmly urged into the closed position but it is readily moved when desired, by finger pressure, into the delivery position. The spring 58 is totally enclosed within the spoon slide 23 by the base 27, the cover 33 and the tongue 41.

The volume of the chamber 42 is readily adjusted and set at a certain magnitude by moving the tongue 41 longitudinally relative to the sloping forward end 59 of the spoon slide 23. Any mechanism may be used for this purpose but good results are obtained using a detent system for providing selected positioning of the tongue 41 within the spoon slide 23.

As seen in FIGS. 12–14, the detent system includes a bow spring 61 secured mid length to the end 43 of the tongue 41. The free ends 62 and 63 of the bow spring 61 fall rearwardly beneath the end 44 and rest resiliently against the parallel sides 64 and 66 of the spoon slide 23. Detent buttons 67 and 68 are secured (as by welding or swedging) to the spring ends 62 and 63, respectively, and they extend laterally outwardly through the sides 64 and 66 via an elongated opening 69 and 71. The buttons have mid length reduced portions 72 and 73. The openings are identical, so only the opening 71 will be described in detail.

The button 68 has a uniform diameter body portion 74 between the spring 61 and the reduced diameter portion 73. The button 68 may also have a uniform diameter portion 76 adjacent its free end that preferably is well rounded and smooth in surface to avoid snagging upon clothing, etc.

The opening 71 has strip portions 77 of uniform width interposed with circular openings 78, 79 and 81. These openings 78, 79 and 81 snuggly confine the button 68 at its uniform diameter portion 74 and 76. When the buttons are inwardly depressed to place the reduced diameter portions 72 and 73 within the openings 69 and 71, as shown in FIG. 13, the buttons and tongue 41 can be moved laterally within the openings until the buttons are aligned with one of the circular openings 78, 79 and 81. Then, the buttons are released and the spring 61 forces them outwardly, thereby fitting snuggly the uniform body portion 74 into the circular openings, as seen in FIG. 14. As a result, the tongue 41 is securely locked to the spoon slide 23, and the volume of chamber 42 has been preset. If a different volume of dose is desired, the chamber 42 is changed to the new volume by laterally moving the tongue 41 within the spoon slide 23.

Although the dispenser 21 can be constructed from a variety of metals, it is preferred to manufacture same from stainless steel, especially the springs 58 and 61, when the dispenser is used to carry and deliver doses of snuff, a pulverulent powder that readily rusts regular steel.

From the foregoing, there has been described, a unique dispenser that can be operated by one hand but delivers to the user a selected volume in doses of a desired powdered material but that can be carried without suffering accidental loss of materials. It will be appreciated that certain changes or alterations may be made to the dispenser without departing from the spirit of this invention. These changes are contemplated by and are within the scope of the appended claims which define the invention. Additionally, the present description is intended to be taken as an ilustration of this invention.

What is claimed is:

1. A dispenser for metering doses of a pulverulent material from an open end of a container to a user, the dispenser comprising:

(a) a cap adapted to be mounted upon the open end of the container by an upstanding rim;

(b) said cap having a flat base with parallel guides and a passage between said guides to the open end of the container;

(c) an elongated spoon slide mounted in said guides to reciprocate laterally across said flat base between closed and delivery positions;

(d) a valve tongue mounted in said spoon slide such that a first side of the tongue forms a transverse divider defining a chamber at one end of the slide for measuring a dose of the material and such that a second side of the tongue forms a gate for closing off the passage in the base, said valve tongue being aligned in the spoon slide relative to the passage in the flat base of the cap and the rim of the cap such that (1) when the slide is reciprocated laterally to the slide-delivery position, the gate side of the tongue moves to a gate-closed position where the gate covers and closes off the cap passage so that no material can emerge from the container through the passage and where the slide chamber is exposed beyond the rim of the cap for a delivery of a dose of the material to the user, and (2) when the slide is reciprocated laterally to the slide-closed position, the gate side of the tongue moves to a gate-open position where the gate does not cover and close off the cap passage and where the slide chamber is positioned over the cap passage so that material can emerge from the container through the passage to fill the slide chamber.

2. The dispenser of claim 1 wherein said valve tongue has a right angle configuration.

3. The dispenser of claim 2 wherein said valve tongue is moveably mounted in said spoon slide for varying the volume of the dose of material received in said chamber.

4. The dispenser of claim 3 wherein said mounting of said valve tongue provides for positioning at several preselected positions in said spoon slide.

5. The dispenser of claim 4 wherein said mounting includes detent means for securing said valve tongue at one of said selected positions in said spoon slide.

6. The dispenser of claim 5 wherein said spoon slide carries longitudinally spaced openings adapted to be selectively engaged by spring loaded detent pins carried by said valve tongue whereby said valve tongue can be secured at any one of said selected positions in said spoon slide.

7. The dispenser of claim 2 wherein said flat base includes a flat guide strip between said guides, said strip extending across said flat base from said passage to said rim of said gap and said strip interposed between said gate on said valve tongue and said spoon slide.

8. The dispenser of claim 7 wherein said strip adjacent said passage in said base carries a spring anchor, and a compression spring is confined between said spring anchor and said spoon slide at its end remote from said chamber.

9. The dispenser of claim 1 wherein said spoon slide has an elongated body formed of parallel sides slideably engaged on bend edges by said guides and a flat bottom between said sides, and sloping walls at the ends of said spoon slide.

10. A dispenser for metering doses of a pulverulent material from the open flat end of a cylindrical container to a user, the dispenser comprising:

(a) a cylindrical cap adapted to be mounted about the open end of the container by an upstanding rim;

(b) said cap having a flat base with parallel guides extending substantially diametrically across said base;

(c) said base having a passage between said guides adjacent to said rim for providing communication with the open end of the container;

(d) an elongated spoon slide mounted in said guides to reciprocate laterally across said base between closed and delivery positions;

(e) said spoon slide having an elongated boat-like body formed of parallel sides slideably engaged on bent edges by said guides, a flat bottom between said sides, and sloping walls at the ends of said spoon slides;

(f) a valve tongue mounted in said spoon slide defining at one end thereof a chamber for measuring a dose of the material, and a gate to close said passage;

(g) said valve tongue having a right angle configuration with a first end forming a transverse divider for defining said chamber and a second end forming said gate to close said passage in said base;

(h) said valve tongue moveably mounted in said spoon slide and carrying detent means for securing said valve tongue in longitudinal slots formed in said sides of said spoon valve whereby the volume of the dose of material in said chamber can be selected by the user;

(i) said base including a flat guide strip between said guides and extending across said base from said passage to said rim of said cap, and said strip interposed between said gate on said valve tongue and said spoon slide;

(j) said strip adjacent said passage in said base carrying a spring anchor;

(k) a compression spring confined between said spring anchor and said spoon slide at its end remote from said chamber for biasing said spoon slide into the closed position;

(l) said spoon slide in the closed position aligning said chamber with said passage whereby the material can fill said chamber; and (m) said spoon slide in the delivery position placing said gate across said passage in said base and exposing said chamber for delivery of a dose of the material to the user.

* * * * *